US008978382B2

(12) United States Patent
Huber et al.

(10) Patent No.: US 8,978,382 B2
(45) Date of Patent: Mar. 17, 2015

(54) COMBUSTION DEVICE WITH A LAYERED WALL STRUCTURE FOR A GAS TURBINE

(75) Inventors: Andreas Huber, Baden (CH); Nicolas Noiray, Bern (CH); Urs Benz, Gipf-Oberfrick (CH); Felix Reinert, Wettingen (CH); Diane Lauffer, Wettingen (CH)

(73) Assignee: Alstom Technology Ltd., Baden (CH)

( * ) Notice: Subject to any disclaimer, the term of this patent is extended or adjusted under 35 U.S.C. 154(b) by 912 days.

(21) Appl. No.: 13/031,654

(22) Filed: Feb. 22, 2011

(65) Prior Publication Data

US 2011/0203250 A1 Aug. 25, 2011

(30) Foreign Application Priority Data

Feb. 22, 2010 (EP) ..... 10154284

(51) Int. Cl.
*F02C 7/24* (2006.01)
*F23R 3/00* (2006.01)

(52) U.S. Cl.
CPC ..... *F23R 3/002* (2013.01); *F23M 99/005* (2013.01); *F23R 2900/00014* (2013.01)
USPC ..... 60/725; 60/752; 431/114

(58) Field of Classification Search
USPC ..... 60/725, 752; 431/114
See application file for complete search history.

(56) References Cited

U.S. PATENT DOCUMENTS 4,607,684 A * 8/1986 Wiard et al. ..... 165/70
5,644,918 A * 7/1997 Gulati et al. ..... 60/725
6,640,544 B2 * 11/2003 Suenaga et al. ..... 60/725
7,311,175 B2 * 12/2007 Proscia et al. ..... 181/290
7,337,875 B2 * 3/2008 Proscia et al. ..... 181/214
7,413,053 B2 * 8/2008 Wasif et al. ..... 181/293
7,549,290 B2 * 6/2009 Holt et al. ..... 60/725
7,832,211 B2 * 11/2010 Ikeda et al. ..... 60/725
8,469,141 B2 * 6/2013 Wang et al. ..... 181/213
2005/0223707 A1 * 10/2005 Ikeda et al. ..... 60/725
2005/0229581 A1 10/2005 Bellucci et al.
2007/0034447 A1 2/2007 Proscia et al.

(Continued)

FOREIGN PATENT DOCUMENTS

DE 19640980 A1 * 4/1998 ..... F23R 3/02
EP 1 251 313 A2 10/2002
EP 1 434 006 A2 6/2004

(Continued)

OTHER PUBLICATIONS

Search Report from European Patent Application No. 10154284.3 mailed on Sep. 9, 2010.

*Primary Examiner* — Ehud Gartenberg
*Assistant Examiner* — Lorne Meade
(74) *Attorney, Agent, or Firm* — Buchanan Ingersoll & Rooney PC

(57) ABSTRACT

A combustion device for a gas turbine includes an interior portion, an inner wall having a plurality of first passages and an outer wall having a plurality of second passages configured to cool the inner wall, each of the plurality of second passages having an outlet opening into a third passage. An intermediate layer is disposed between the inner wall and the outer wall and defines a plurality of chambers, each chamber forming a Helmholtz damper and being connected to the interior portion by at least one of the plurality of first passages and being connected to at least one of the plurality of second passages by at least one of the plurality of third passages.

15 Claims, 6 Drawing Sheets

(56) References Cited

U.S. PATENT DOCUMENTS

| | | | | |
|---|---|---|---|---|
| 2011/0048018 | A1* | 3/2011 | Schnell et al. | 60/722 |
| 2011/0265484 | A1* | 11/2011 | Huber et al. | 60/755 |

FOREIGN PATENT DOCUMENTS

| | | | |
|---|---|---|---|
| ER | 1 666 795 | A1 | 6/2006 |
| GB | 2 390 150 | A | 12/2003 |

* cited by examiner

COMBUSTION DEVICE WITH A LAYERED WALL STRUCTURE FOR A GAS TURBINE

CROSS REFERENCE TO PRIOR APPLICATIONS

Priority is claimed to European Patent Convention Application No. EP 10 154 284.3, filed Feb. 22, 2010, the entire disclosure of which is incorporated by reference herein.

FIELD

The present invention relates to a combustion device for a gas turbine. In an embodiment, the present invention refers to lean premixed low emission combustion devices. The combustion device may be the first and/or the second combustion device of a sequential combustion gas turbine or a combustion device of a traditional gas turbine (i.e. a gas turbine not being a sequential combustion gas turbine). For sake of simplicity and clarity, in the following only reference to a reheat combustion device (i.e. the second combustion device of a sequential combustion gas turbine) is made.

BACKGROUND

During gas turbine operation, heavy thermo acoustic pulsations may be generated in the combustion chamber, due to an unfavourable coupling of acoustic and fluctuation of heat release rate (combustion). The risk of thermo acoustic pulsation generation is particularly high when the gas turbine is provided with lean premixed low emission combustion devices.

These pulsations act upon the hardware of the combustion device and the turbine to heavy mechanical vibrations that can result in the damage of individual parts of the combustion device or turbine; therefore pulsation must be suppressed.

In order to suppress oscillations, combustion devices are usually provided with damping devices; typically damping devices consist of quarter wave tubes, Helmholtz dampers or acoustic screens.

US2005/0229581 discloses a reheat combustion device with a mixing tube and a front plate. The front plate has an acoustic screen having holes; parallel to the acoustic screen and apart from it, an impingement plate also provided with holes, ensuing cooling of the device, is provided.

During operation, air (from a plenum containing the combustion device) passes through the impingement plate, impinges on the acoustic screen (cooling it) to then pass through the acoustic screen and enter the combustion chamber. Nevertheless this damping system has some drawbacks. In fact, cooling of the acoustic screen requires a large air mass flow, which must be diverted from the plenum into the damping volume in order to cool it.

This, in addition to reducing the damping efficiency, also increases the air mass flow, which does not take part in the combustion, such that the flame temperature increases and the NOx emissions are consequently high.

SUMMARY OF THE INVENTION

An aspect of the present invention is therefore to provide a combustion device by which the said problems of the known art are eliminated.

An embodiment of the invention provides a combustion device in which a reduced air mass flow (when compared to traditional combustion devices) is diverted from the plenum into the damping volume.

Another embodiment of the invention provides a combustion device that has a high damping efficiency and limited NOx emissions when compared to corresponding traditional devices.

Advantageously, the cooling device in the embodiments of the invention does not have any influence or only a limited influence on the damping performance in terms of frequency and efficiency.

BRIEF DESCRIPTION OF THE DRAWINGS

Further characteristics and advantages of the invention will be more apparent from the description of a preferred but non-exclusive embodiment of the combustion device according to the invention, illustrated by way of non-limiting example in the accompanying drawings, in which.

DETAILED DESCRIPTION

Figure 1:
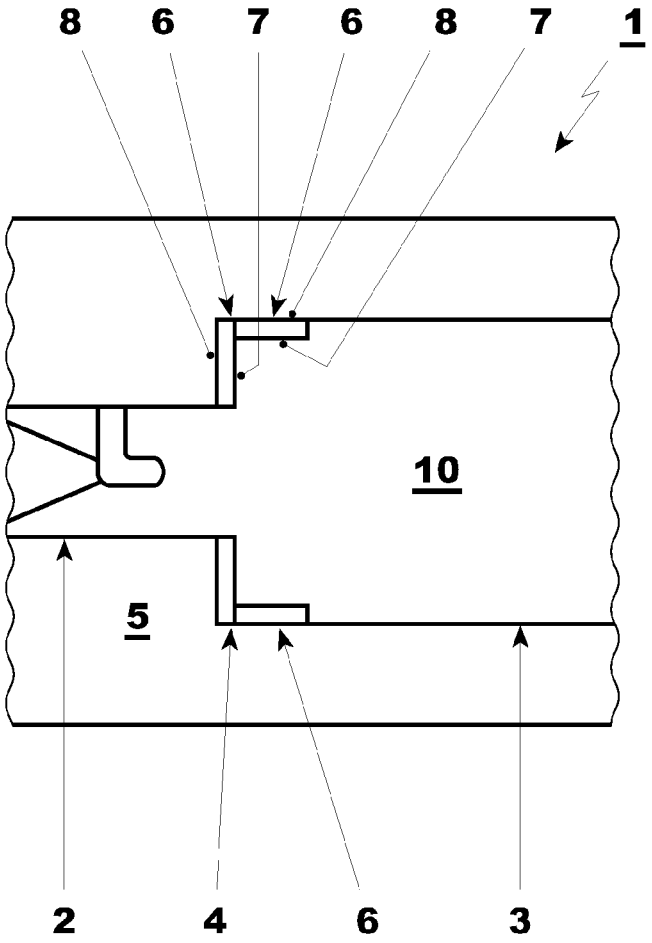
FIG. 1 is a schematic view of a reheat combustion device.

With reference to the figures, these show a combustion device generally indicated by the reference number 1.

The combustion device 1 has a mixing tube 2 and a combustion chamber 3 connected to each other via a front plate 4; these elements are contained in a plenum 5 into which compressed air coming from a compressor (the compressor of the gas turbine) is fed.

Above a combustion device being the second combustion device of a sequential combustion gas turbine was described, it is anyhow clear that in different embodiments of the invention the combustion device may also be the first combustion device of a sequential combustion gas turbine or also the combustion device of a traditional gas turbine having one single combustion device or combustion device row. These combustion devices are well known in the art and are not described in detail in the following; for sake of simplicity and clarity reference only to the second combustion device of a sequential combustion gas turbine is hereinafter made.

The combustion device 1 comprises portions 6 provided with an inner and an outer wall 7, 8.

These portions 6 may be located at the front plate 4 and partly at the combustion chamber wall (as shown in FIG. 1) or, in other embodiments, at the mixing tube wall, at the front plate, at the combustion chamber wall or also a combination thereof (i.e. at the wall of the mixing tube 2 and/or combustion chamber 3 and/or front plate 4).

The inner wall 7 has first passages 9 connecting the zone between the inner and outer wall 7, 8 to the inside 10 of the combustion device 1.

In addition second passages 12 are provided, having inlets 13 connected to the outer 14 of the combustion device 1 and passing through the outer wall 8 for cooling the inner wall 7.

Between the inner and outer wall 7, 8 an intermediate layer 17 is provided defining a plurality of chambers 18.

Each chamber 18 is connected to one or more than one first passage 9 and a plurality of second passages 12 and defines one or a plurality of Helmholtz dampers.

The second passages 12 open in third passages 22 connected to the chamber 18; in addition, the second passages 12 have facing outlets 23.

The third passages 22 open at the same side of the chambers 18 as the first passages 9 and the second passages 12 have a portion extending parallel to the inner wall 7.

Figure 2:
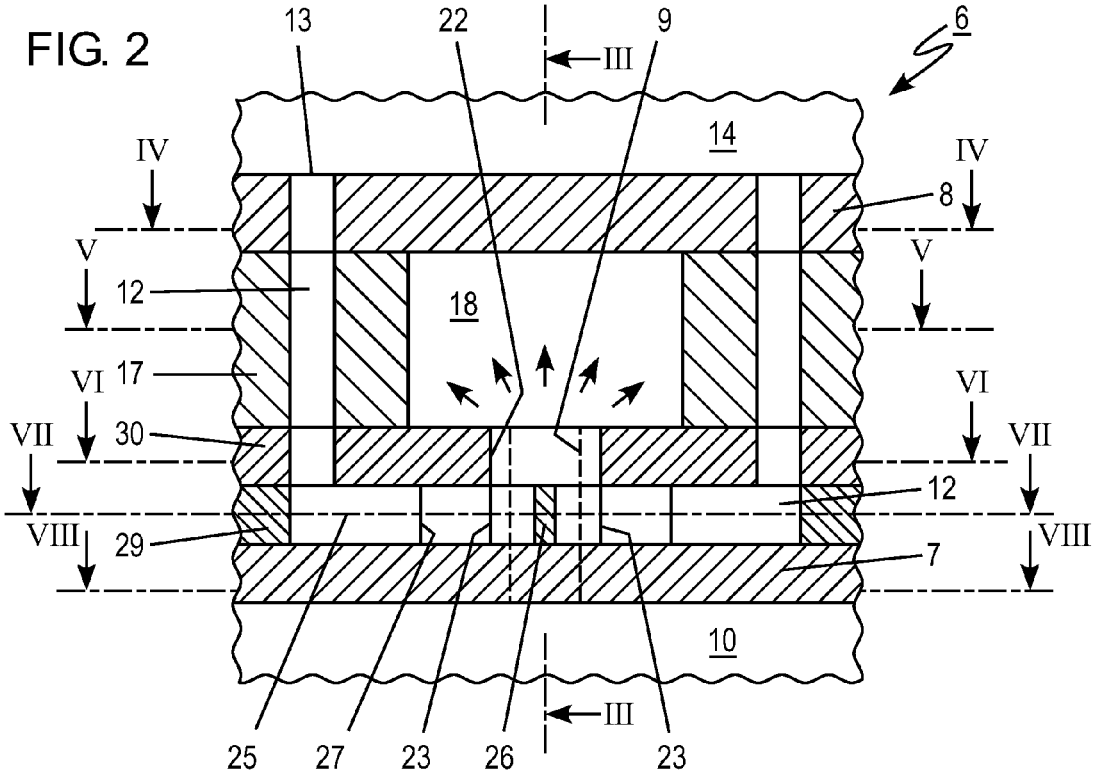
FIG. 2 is a cross section of the front plate of the mixing tube.
Figure 3:
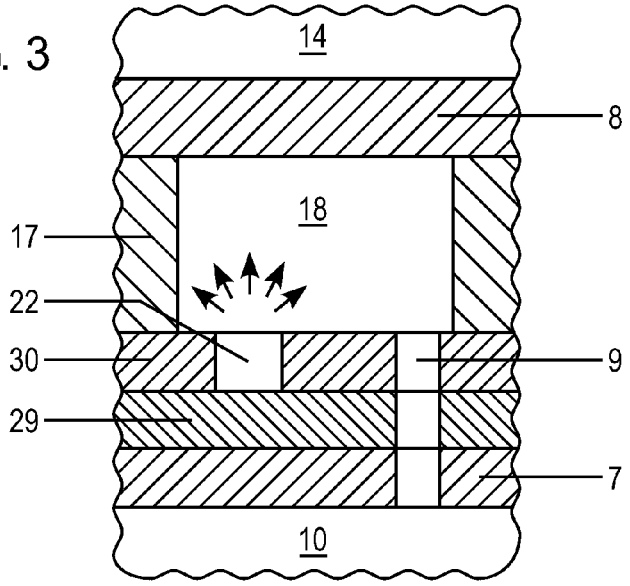
FIG. 3 is a cross section through lines III-III of FIG. 2.

For sake of clarity, in FIG. 2 the first passage 9 and the third passage 22 are shown with a different diameter; it is anyhow clear that in different embodiments their diameter may also be the same or each between the first passage 9 and the third passage 22 may have the largest and/or the smallest diameter.

As shown, the second passages 12 have portions associated in couples with overlapping longitudinal axis 25.

Preferably, between the facing outlets 23 of the associated second passages 12 an obstacle 26 in provided, for example defined by a wall interposed between the associated passages 12.

In addition, advantageously each of the second passages 12 has a diffuser 27 at its outlet 23.

The portion 6 has a layered structure made of at least the inner wall 7, the intermediate layer 17 and outer wall 8 (and eventually also one or more further layers interposed between the first and second wall 7, 8); this layered structure is made of a plurality of plates (defining the inner and outer wall 7, 8, the interposed layer 17 and the eventual further layers) connected one to the other and provided with apertures to define the first, the second and the third passages 9, 12, 22 and the chambers 18.

In one embodiment the apertures defining the first, the second and the third passages 9, 12, 22 and the chambers 18 are through apertures; this embodiment is shown in FIG. 2.

In this embodiment between the first and the second wall 7, 8, in addition to the intermediate layer 17, also two further layers 29 (cooling passage layer), 30 (separation layer) are provided, such that the layered structure is made of five plates one connected to the other (for example brazed or via screws).

In a different embodiment the apertures defining the first, the second and the third passages 9, 12, 22 and the chambers 18 comprise one or more blind apertures.

In this respect the inner wall 7 and the layer 29 may be manufactured in one element, in this case the portions of the first passages 12 in the layer 29 are defined by blind apertures (for example blind millings); the portions of the third passages 22 are defined by a portion of the same millings or by a blind aperture connected thereto (for example a blind hole, example not shown). The portions of the first passages 9 in the wall 7 and layer 29 are defined by through apertures (for example through holes).

The layer 30 may be realised in one element with through apertures (such as through holes) defining the portion of the first, second and third passages 9, 12, 22 through it.

The outer wall 8 and the intermediate layer 17 may be realised in one element with through apertures (through holes) defining the portion of the second passages 12 through it and blind apertures (blind holes) defining the chambers 18.

Naturally further different embodiments are possible, for example the inner wall 7 may be manufactured in one element, the two layers 29, 30 may also be manufactured in one element and the intermediate layers 17 and outer wall 8 in one element; alternatively the outer layers may be manufactured in one element, the layers 17 and 30 in one element and the inner wall 7 and layer 29 in one element. It is clear that also further embodiments are possible that are not described in detail for brevity and because they are clear for the skilled in the art on the basis of what explained.

For sake of clarity, FIGS. 4-8 show a possible implementation of a layered structure made of five different elements; all the apertures in these elements are through apertures (holes or millings).

Figure 4:
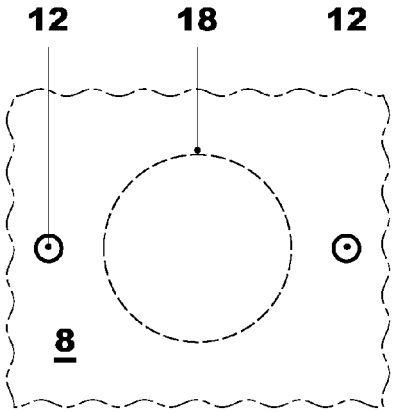
FIG. 4 is a top view cross section through lines IV-IV of FIG. 2 of plate portions for manufacturing a front plate.

FIG. 4 shows the outer wall 8; in this figure the apertures defining the portion of the second passages 12 through this wall are shown; in addition the chamber 18 (defined in the intermediate layer 17) is shown in dotted line.

Figure 5:
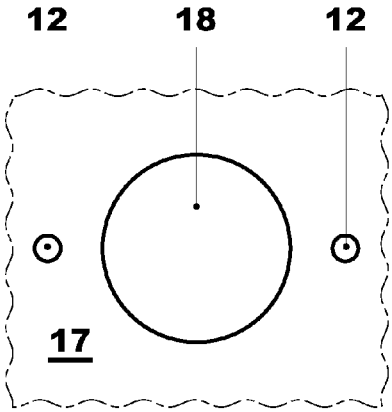
FIG. 5 is a top view cross section through lines V-V of FIG. 2 of plate portions for manufacturing a front plate.

FIG. 5 shows the intermediate wall 17; in this figure the apertures defining the portion of the second passages 12 through this wall and the chamber 18 are shown.

Figure 6:
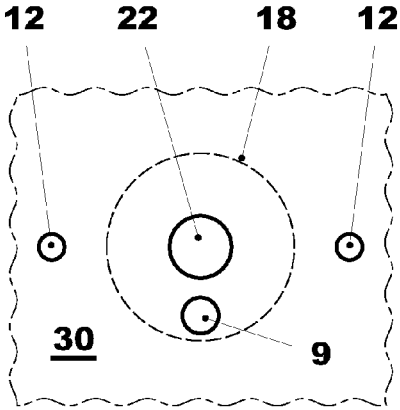
FIG. 6 is a top view cross section through lines VI-VI of FIG. 2 of plate portions for manufacturing a front plate.

FIG. 6 shows the layer 30; in this figure the apertures defining the portion of the second passages 12 and of the first passages 9 and, in addition, the third passage 22 through this wall are shown; in addition the chamber 18 (defined in the intermediate layer 17) is shown in dotted line.

Figure 7:
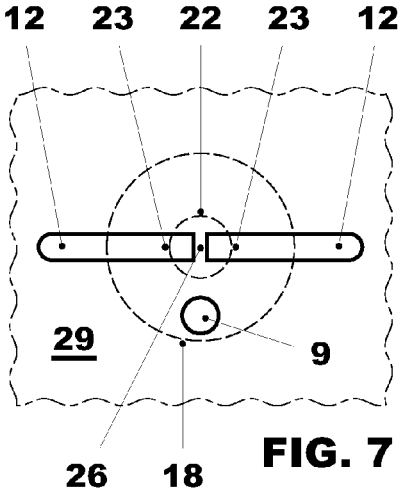
FIG. 7 is a top view cross section through lines VII-VII of FIG. 2 of plate portions for manufacturing a front plate.

FIG. 7 shows the layer 29; in this figure the apertures (millings) defining the portion of the second passages 12 and the aperture (typically a hole) defining the portion of the first passages 9 through this wall are shown; the third passage 22 (defined in the layer 30) and the chamber 18 (defined in the intermediate layer 17) are also shown in dotted line; in addition the portion of the third passages 22 in the layer 29 and the outlets 23 are indicated. Also the obstacle 26 is shown in this figure.

Figure 8:
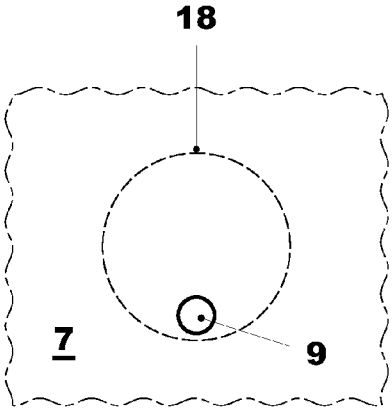
FIG. 8 is a top view cross section through lines VIII-VIII of FIG. 2 of plate portions for manufacturing a front plate.

FIG. 8 shows the inner wall 7; in this figure the portion of the first passage 9 through this wall is shown; in addition the chamber 18 (defined in the intermediate layer 17) is also shown in dotted line.

Figure 9:
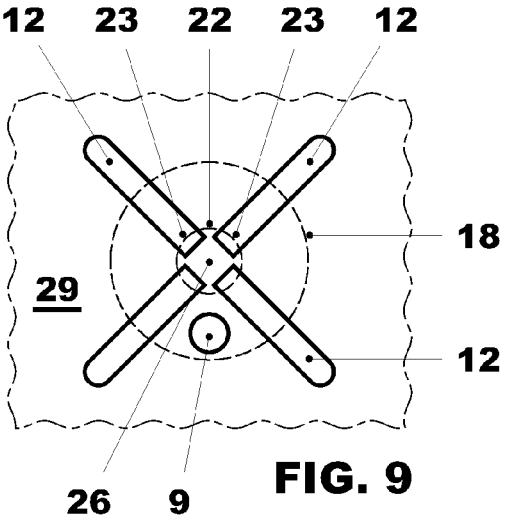
FIGS. 9-12 are different embodiments of the plate defining conduits parallel to a wall delimiting the interior of the combustion device.
Figure 10:
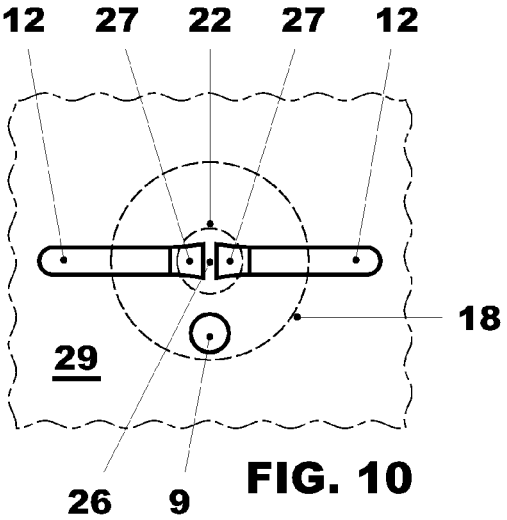
Figure 11:
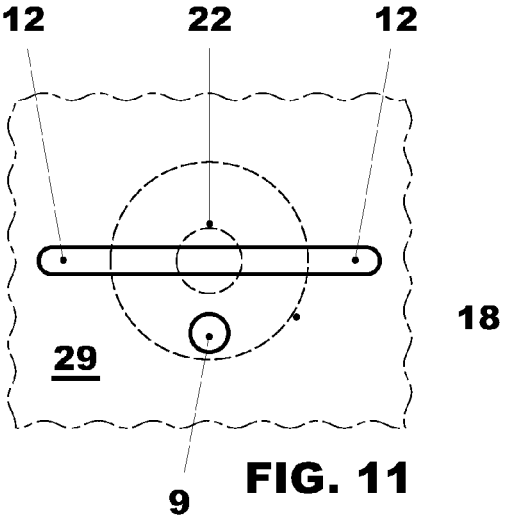

In compliance with what already described, FIGS. 9-11 show further possible embodiments for the layer 29. Like reference numbers define in these figures identical or similar elements; the other walls and layer must be modified accordingly and are not shown in the attached figures. Also in these figures all apertures are through apertures.

FIG. 9 shows an embodiment with four apertures (millings) defining portions of the second passages 12, also in this figure the aperture (hole) defining the portion of the first passages 9 through this wall is shown. Moreover, the third passage 22 (defined in the layer 30), the chamber 18 (defined in the intermediate layer 17), the outlets 23 defined when the layers 29 and 30 are connected one onto the other are shown.

Figure 12:
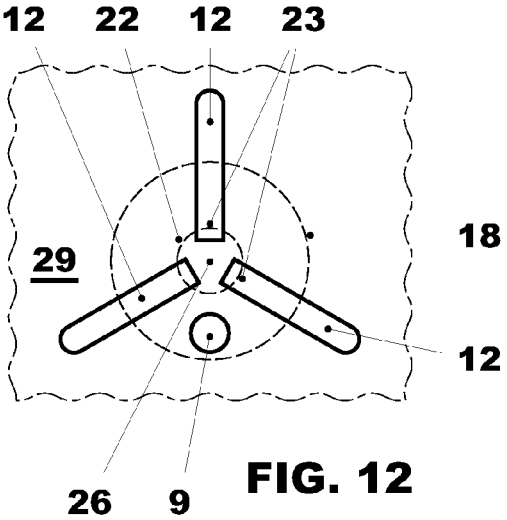

FIG. 10 shows an embodiment with two apertures (being millings) having the diffuser 27, FIG. 11 shows an embodiment without the obstacle 26 between the second passages 12 and FIG. 12 shows an embodiment with three second passages 12 having facing outlets 23 associated to each third passage 22.

Figure 13:
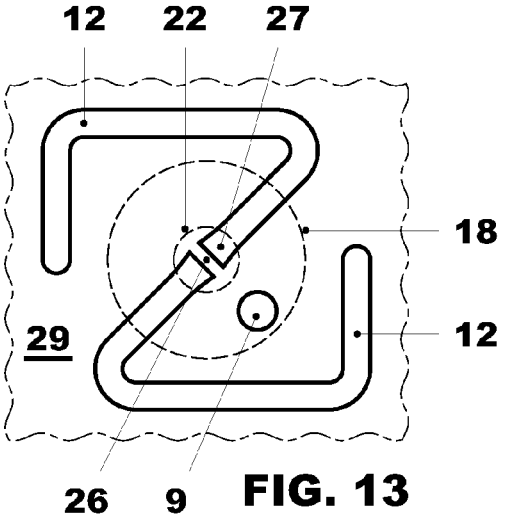
FIG. 13 is a further embodiment of the plate defining conduits parallel to a wall delimiting the interior of the combustion device; the conduits have a coil shape.
Figure 14:
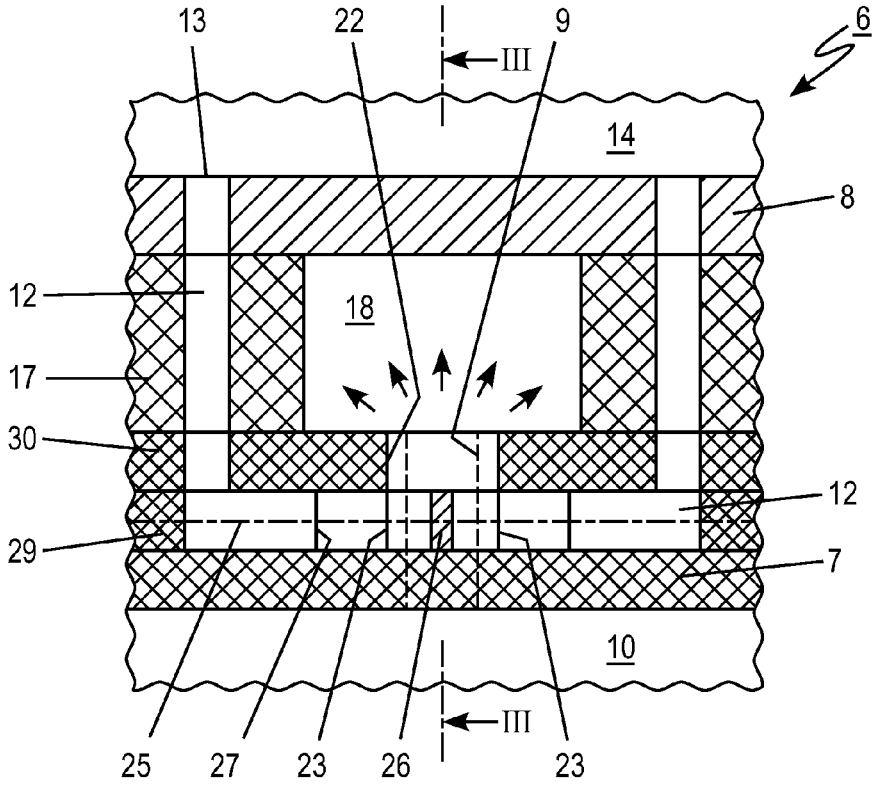
FIG. 14 is a further embodiment of the cross section of the front plate of the mixing tube where the inner wall and the further intermediate layer are one piece.
Figure 15:
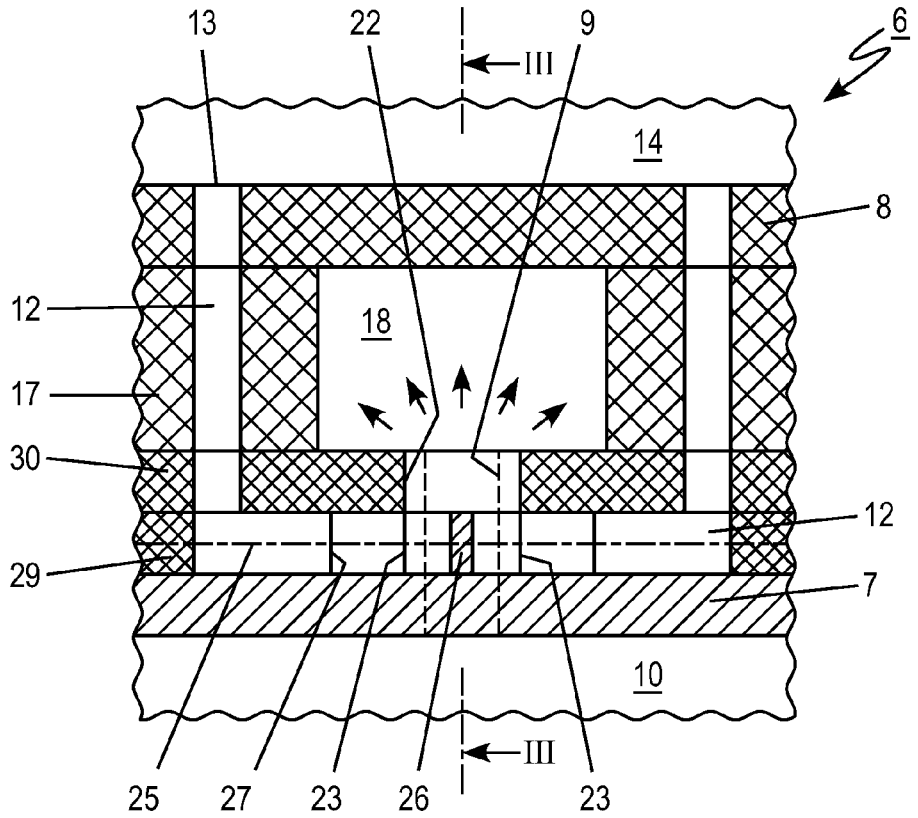
FIG. 15 is a further embodiment of the cross section of the front plate of the mixing tube where the outer wall and the further intermediate layer are one piece.

FIG. 13 shows a further embodiment with two coil shaped apertures.

The operation of the combustion device in the embodiments of the invention is apparent from what described and illustrated and is substantially the following.

Air enters via the inlet 13 and passes through the second passages 12, cooling the portion 6; afterwards air is discharged into the chamber 18. In addition, hot gas oscillates in the first passage 9 damping acoustic pulsations.

When entering the chamber 18, since each air flow coming from a passage 12 impinges on another air flow coming from a facing passage 12, there is no intense air flow entering the chamber 18, but air enters the chamber 18 spreading in all directions; this avoids the formation of an air recirculation zone inside the chamber 18 that may influence the gas oscillation through the first passage 9 affecting the damping effect. For the same reason, the obstacle 26 is preferably provided, such that before each air flow impinges on another air flow, it impinges on the obstacle 26 spreading towards the chamber 18 in all directions.

Likewise, the diffuser 27 causes the air flow that enters the chamber 18 to reduce its kinetic energy, in order to reduce the probability of formation of air recirculation zones within the chamber 18.

Since cooling is very efficient a reduced amount of air may be provided via the second passages 12 into the chambers 18 in order to cool the chambers 18 and the layered structure; this allows high damping efficiency and reduced NOx emissions.

In addition, thanks to the improved cooling, an impact of the cooling on the damping performance is prevented or hindered.

Naturally the features described may be independently provided from one another.

In practice the materials used and the dimensions can be chosen at will according to requirements and to the state of the art.

REFERENCE NUMBERS

1 combustion device
2 mixing tube
3 combustion chamber
4 front plate
5 plenum
6 portion
7 inner wall
8 outer wall
9 first passages
10 interior of 1
12 second passages
13 inlet of 12
14 outer of 1
17 intermediate layer
18 chambers
22 third passages
23 outlets of 12
25 longitudinal axis of portion of 12
26 obstacle
27 diffuser
29 cooling passage layer
30 separation layer

The invention claimed is:

1. A combustion device for a gas turbine comprising:

an interior portion;

an inner wall having a plurality of first passages;

an outer wall having a plurality of second passages configured to cool the inner wall, each of the plurality of second passages having an outlet opening into one of a plurality of third passages; and an intermediate layer disposed between the inner wall and the outer wall and defining a plurality of chambers, each chamber forming a Helmholtz damper and being connected to the interior portion by at least one of the plurality of first passages and being connected to at least one of the plurality of second passages by at least one of the plurality of third passages, wherein said second passages have a portion for cooling the inner wall which is closer to the interior portion of the combustion device than the plurality of chambers, and wherein a first flow path between at least one of the chambers and the interior portion via at least one of the plurality of first passages is separated from a second flow path between the outer wall and the at least one chamber via one of the plurality of second passages.

2. The combustion device as recited in claim 1, wherein the plurality of second passages are disposed in pairs, and wherein the outlets of each second passage pair face each other.

3. The combustion device as recited in claim 2, wherein an outlet of each of the plurality of second passage pairs share a longitudinal axis of symmetry.

4. The combustion device as recited in claim 2, further comprising an obstacle disposed between facing outlets of each of the plurality of second passage pairs.

5. The combustion device as recited in claim 4, wherein the obstacle includes a wall.

6. The combustion device as recited in claim 2, wherein each of the plurality of second passage pairs includes a diffuser disposed at each outlet.

7. The combustion device as recited in claim 1, wherein the inner wall, the intermediate layer and the outer wall are disposed in a layered structure.

8. The combustion device as recited in claim 7, wherein the layered structure includes a plurality of plates disposed one over another, each plate including a plurality of apertures defining the plurality of first, second and third passages and the plurality of chambers.

9. The combustion device as recited in claim 8, wherein at least some of the plurality of apertures are through apertures.

10. The combustion device as recited in claim 8, wherein at least some of the plurality of apertures are blind apertures.

11. The combustion device as recited in claim 1, wherein the at least one of the plurality of first passages connected to the chamber and the at least one of the plurality of third passages connected to the chamber each open into a same side of the chamber.

12. The combustion device as recited in claim 11, wherein each of the plurality of second passages include a portion extending parallel to the inner wall.

13. The combustion device as recited in claim 1, further comprising a further intermediate layer disposed adjacent to the inner wall and partly defining at least one of the plurality of second passages.

14. The combustion device as recited in claim 13, wherein the inner wall and the further intermediate layer are one piece.

15. The combustion device as recited in claim 1, wherein the outer wall and the intermediate layer are one piece.

* * * * *